US010289025B2

(12) United States Patent
Yoshida et al.

(10) Patent No.: US 10,289,025 B2
(45) Date of Patent: May 14, 2019

(54) IMAGE FORMING APPARATUS FOR ELECTROPHOTOGRAPHIC PROCESSING UTILIZING VARYING SURFACE SPEEDS

(71) Applicant: CANON KABUSHIKI KAISHA, Tokyo (JP)

(72) Inventors: Tsuguhiro Yoshida, Yokohama (JP); Shinji Katagiri, Yokohama (JP); Takeo Kawanami, Kamakura (JP); Akinori Mitsumata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/882,366

(22) Filed: Jan. 29, 2018

(65) Prior Publication Data

US 2018/0217522 A1 Aug. 2, 2018

(30) Foreign Application Priority Data

Jan. 31, 2017 (JP) ..... 2017-016205

(51) Int. Cl.

| | |
|---|---|
| ***G03G 15/16*** | (2006.01) |
| ***G03G 15/08*** | (2006.01) |
| ***G03G 9/135*** | (2006.01) |
| ***G03G 9/09*** | (2006.01) |
| ***G03G 9/097*** | (2006.01) |
| ***G03G 13/20*** | (2006.01) |
| ***G03G 21/00*** | (2006.01) |
| *G03G 15/04* | (2006.01) |
| *G03G 15/01* | (2006.01) |

(52) U.S. Cl.

CPC ..... *G03G 15/0867* (2013.01); *G03G 9/09* (2013.01); *G03G 9/097* (2013.01); *G03G 9/1355* (2013.01); *G03G 13/20* (2013.01); *G03G 15/161* (2013.01); *G03G 21/0064* (2013.01); *G03G 15/0115* (2013.01); *G03G 15/04027* (2013.01); *G03G 2215/1661* (2013.01)

(58) Field of Classification Search

CPC ..... G03G 15/01; G03G 15/0189; G03G 15/0178; G03G 15/5054; G03G 15/5058

USPC ..... 399/101, 299, 301

See application file for complete search history.

(56) References Cited

U.S. PATENT DOCUMENTS

| | | | | |
|---|---|---|---|---|
| 8,396,395 | B2 * | 3/2013 | Aoyagi | G03G 15/1605 399/301 |
| 9,141,058 | B2 * | 9/2015 | Saito et al. | G03G 15/0189 |
| 9,645,529 | B2 * | 5/2017 | Onishi et al. | G03G 15/5054 |

FOREIGN PATENT DOCUMENTS

| | | | |
|---|---|---|---|
| JP | 2001-201902 | A | 7/2001 |
| JP | 2004-117722 | A | 4/2004 |
| JP | 2004-233696 | A | 8/2004 |
| JP | 2008-170955 | A | 7/2008 |

* cited by examiner

*Primary Examiner* — William J Royer

(74) *Attorney, Agent, or Firm* — Canon U.S.A., Inc. IP Division

(57) ABSTRACT

An image forming apparatus includes a photosensitive member that rotates at a first speed, an intermediate transfer member that rotates at a second speed lower than the first speed, and a collecting member disposed in a state in which a fixed surface is pressed against the rotating intermediate transfer member. The collecting member collects toner remaining on the intermediate transfer member after a toner image is secondarily transferred from the intermediate transfer member to a transfer material.

16 Claims, 10 Drawing Sheets

FIG. 4

| | SURFACE SPEED Va OF PHOTOSENSITIVE DRUM 4 | | | | | | |
|---|---|---|---|---|---|---|---|
| | 97 mm/sec (3%) | 99 mm/sec (1%) | 100 mm/sec (0%) | 101 mm/sec (1%) | 103 mm/sec (3%) | 105 mm/sec (5%) | 106 mm/sec (6%) |
| IMAGE BLUR (SPEED DIFFERENCE ΔV) | POOR | POOR | GOOD | GOOD | GOOD | GOOD | GOOD |
| COLOR MISALIGNMENT | POOR | POOR | GOOD | GOOD | GOOD | GOOD | GOOD |

IMAGE FORMING APPARATUS FOR ELECTROPHOTOGRAPHIC PROCESSING UTILIZING VARYING SURFACE SPEEDS

BACKGROUND OF THE INVENTION

Field of the Invention

The present disclosure relates to image forming apparatuses using electrophotographic processing or the like.

Description of the Related Art

For electrophotographic image forming apparatuses, there is a known configuration in which toner images are sequentially transferred from image forming units of individual colors to an intermediate transfer member, and the toner images are transferred collectively from the intermediate transfer member to a transfer material.

In such image forming apparatuses, each of the image forming units of individual colors includes a drum-shaped photosensitive member serving as an image bearing member. At the time of image formation, toner images developed on the photosensitive members are primarily transferred from the photosensitive members to the intermediate transfer member in a primary transfer portion at which the photosensitive members and the intermediate transfer member are in contact with each other. The toner images of individual colors that are primarily transferred to the intermediate transfer member are secondarily transferred collectively from the intermediate transfer member to a transfer material, such as paper or an overhead projector (OHP) sheet, in a secondary transfer portion in which the intermediate transfer member and a secondary transfer member are in contact with each other and are thereafter fixed onto the transfer material by a fixing unit.

Japanese Patent Laid-Open No. 2004-117722 discloses a configuration in which the surface speed of the intermediate transfer member is set to be higher than the surface speed of the photosensitive member so as to improve the transfer performance of the primary transfer of the toner images from the photosensitive members to the intermediate transfer member. In such a configuration, the primary transfer is performed using a shearing force of shearing the toner images carried by the photosensitive member with the intermediate transfer member.

However, in a so-called cleanerless configuration in which a blade serving as a cleaning member in contact with each photosensitive member is not provided, when the surface speed of the intermediate transfer member is set higher than the surface speed of the photosensitive members, as in Japanese Patent Laid-Open No. 2004-117722, as in Japanese Patent Laid-Open No. 2004-117722, the following problem can occur. That is, in the cleanerless configuration, the load for rotationally driving the photosensitive members is small, so that the photosensitive members are taken along the surface of the intermediate transfer member, causing the positions of the toner images formed on the surface of the photosensitive member to be misaligned to generate image defect.

SUMMARY OF THE INVENTION

The present disclosure provides a configuration for an image forming apparatus in which the load for rotationally driving photosensitive members is small in which generation of image defect is prevented while a difference is provided between the surface speed of the photosensitive members and the surface speed of the intermediate transfer member.

The present disclosure provides an image forming apparatus including a photosensitive member, a developing unit configured to develop a toner image on the photosensitive member, an endless rotatable intermediate transfer member in contact with the photosensitive member, and a collecting member. The toner image carried on the photosensitive member is primarily transferred to the intermediate transfer member. Toner remaining on the photosensitive member after the toner image is primarily transferred from the photosensitive member to the intermediate transfer member can be collected by the developing unit. The collecting member can collect toner remaining on the intermediate transfer member after the toner image primarily transferred from the photosensitive member to the intermediate transfer member is secondarily transferred from the intermediate transfer member to a transfer material by pressing a fixed surface of the collecting member against the rotating intermediate transfer member. The photosensitive member rotates at a first speed, and the intermediate transfer member rotates at a second speed lower than the first speed.

Further features of the present disclosure will become apparent from the following description of exemplary embodiments with reference to the attached drawings.

BRIEF DESCRIPTION OF THE DRAWINGS

FIG. 4 is a table illustrating the result of evaluation of whether an image defect and color misalignment have occurred at various speed differences in the first embodiment.

DESCRIPTION OF THE EMBODIMENTS

Embodiments of the present disclosure will be described in detail herein below with reference to the drawings. It is to be understood that the dimensions, materials, shapes, and the relative positions of the components described in the embodiments can be changed as appropriate according to the configuration of an apparatus that incorporates the present disclosure and various conditions and that the present disclosure is not limited to the embodiments.

First Embodiment

Figure 1:
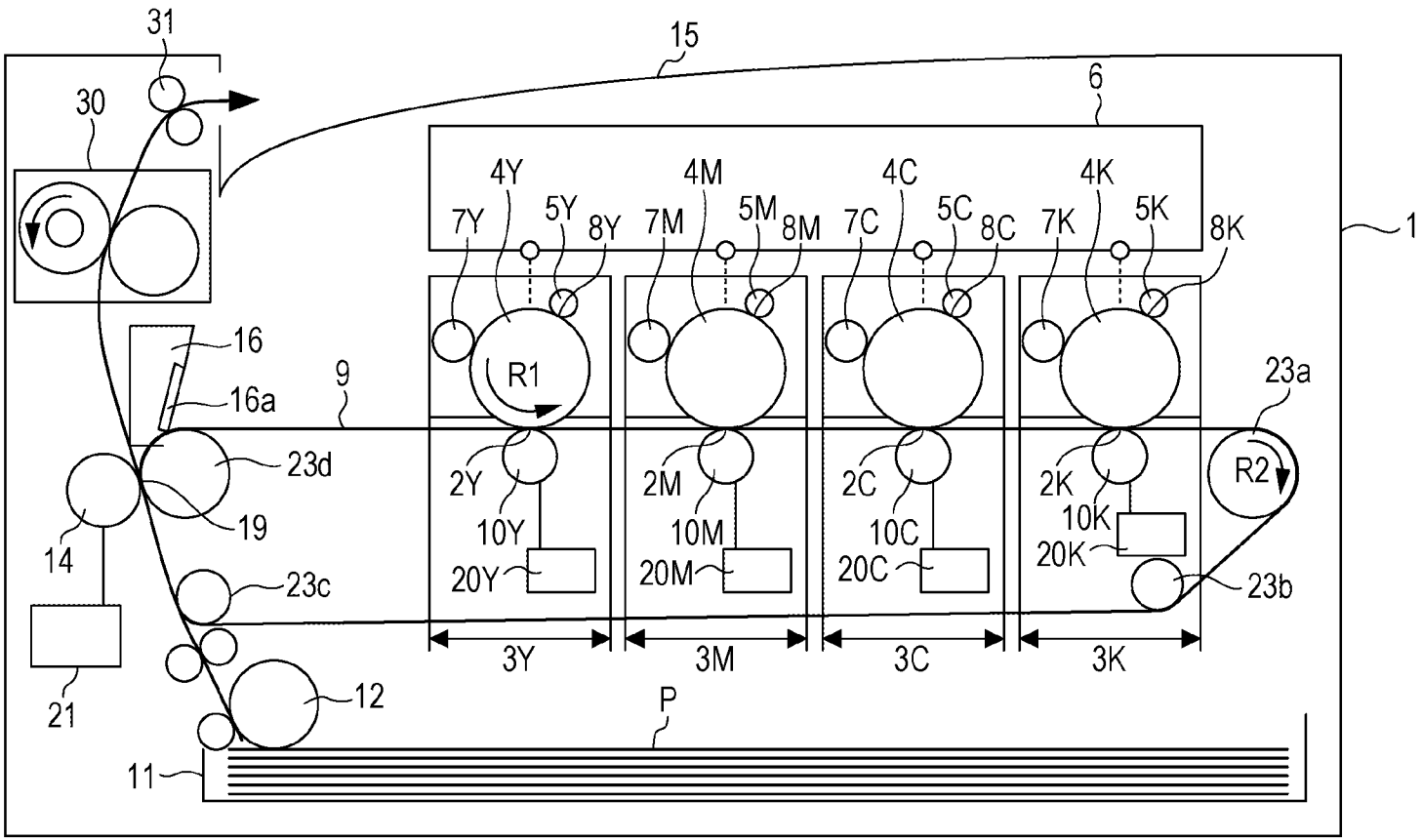
FIG. 1 is a sectional view of an image forming apparatus of a first embodiment illustrating, in outline, the configuration of thereof.

FIG. 1 is a schematic diagram illustrating the configuration of an image forming apparatus 1 of a first embodiment. As illustrated in FIG. 1, the image forming apparatus 1 is a color-image forming apparatus in which image forming units 3Y, 3M, 3C, and 3K that respectively form yellow (Y), magenta (M), cyan (C), and black (K) images are disposed at regular intervals. In the present embodiment, the configurations and operations of the image forming units 3Y, 3M, 3C, and 3K are substantially the same except that the colors of images to be formed differ. For that reason, suffixes Y, M, C, and K attached to the signs to indicate the respective colors are omitted unless otherwise distinguished.

The image forming unit 3 includes a drum-shaped electrophotographic photosensitive member 4 (hereinafter referred to as "photosensitive drum 4"), a charging roller 5, which is a charging member that is in contact with the photosensitive drum 4 to charge the photosensitive drum 4, an exposing unit 6, and a developing unit 7. The developing unit 7 is disposed so as to come into and out of contact with the photosensitive drum 4 and develops an electrostatic latent image formed on the photosensitive drum 4 with toner when a voltage is applied from a developing power source (not shown). In the present embodiment, the photosensitive drum 4 is a negatively charged organic photoconductor having a diameter of 24 mm in which at least a charge generation layer and a charge transport layer containing a polyarylate resin are disposed on an aluminum cylinder.

When a control unit (not shown), such as a controller, receives an image signal, an image forming operation is started, and the photosensitive drum 4 is rotationally driven in the direction of arrow R1. In the course of rotation, the photosensitive drum 4 is uniformly charged to a predetermined voltage (charging voltage) with a predetermined polarity (in the present embodiment, negative polarity) by the charging roller 5 and is exposed to light by the exposing unit 6 according to the image signal. In this manner, an electrostatic latent image corresponding to the color component of the target color image is formed on the photosensitive drum 4. Subsequently, the electrostatic latent image is developed at a developing position by the developing unit 7 and is visualized as a toner image on the photosensitive drum 4. The regular charge polarity of the toner contained in the developing unit 7 is negative, so that the electrostatic latent image is reversely developed with the toner charged to the same polarity as the polarity of the photosensitive drum 4 charged by the charging roller 5. However, this is given for mere illustration. The present disclosure can also be applied to an image forming apparatus that develops the electrostatic latent image with a toner charged to a polarity opposite to the charged polarity of the photosensitive drum 4.

An intermediate transfer belt 9, which is an endless rotatable belt-like intermediate transfer member, is stretched round a driving roller 23*a*, which is an electrically conductive rotary member, a driven roller 23*b*, an auxiliary roller 23*c*, and a facing roller 23*d*, which is a facing member. The driving roller 23*a*, the driven roller 23*b*, and the auxiliary roller 23*c* are electrically connected to the ground. The driving roller 23*a* rotates in the direction of arrow R2, so that the intermediate transfer belt 9 rotates at a circumferential speed of 100 mm/sec. A primary transfer roller 10, which is a contact member that is in contact with the intermediate transfer belt 9, is disposed at a position of the inner circumferential surface of the intermediate transfer belt 9 facing the photosensitive drum 4 with the intermediate transfer belt 9 therebetween.

The intermediate transfer belt 9 of the present embodiment has an outer perimeter of about 700 mm and a thickness of about 80 μm and includes an endless polyimide (PI) base layer in which carbon is added as a conductive agent and a surface layer formed on the base layer and containing an acrylic resin. A thickness t1 of the base layer is 78 μm, and a thickness t2 of the surface layer is 2 μm. The volume resistivity of the intermediate transfer belt 9 measured with Hiresta-UP (MCP-HT450) and a ring probe of type UR (MCP-HTP12) manufactured by Mitsubishi Chemical Corporation was about $5\times10^9$ Ω·cm. The volume resistivity was measured under the condition that the ring probe was brought into contact with the surface of the intermediate transfer belt 9 at an applied voltage of 100 V, and a measurement time of 10 seconds. The measurement environment was as follows: an indoor temperature of 23° C., and an indoor humidity of 50%.

When the primary transfer roller 10 presses the intermediate transfer belt 9 against the photosensitive drum 4, the intermediate transfer belt 9 abuts the photosensitive drum 4 to form a primary transfer portion 2. In the present embodiment, the distance between the primary transfer rollers 10 in the moving direction of the intermediate transfer belt 9 is about 75 mm. The primary transfer roller 10 connects to a primary transfer power source 20 (a first power source). By applying a voltage from the primary transfer power source 20 to the primary transfer roller 10, a current flows through the intermediate transfer belt 9 via the primary transfer roller 10. The toner image formed on the photosensitive drum 4 is primarily transferred from the photosensitive drum 4 to the intermediate transfer belt 9 by applying a positive voltage from the primary transfer power source 20 to the primary transfer roller 10 while passing through the primary transfer portion 2.

The image forming apparatus 1 of the present embodiment has a so-called cleanerless configuration in which toner remaining on the photosensitive drum 4 after the toner image is transferred from the photosensitive drum 4 to the intermediate transfer belt 9 is collected by the developing unit 7.

In the cleanerless configuration, a blade in contact with the photosensitive drum 4 is not provided between the primary transfer portion 2 at which the photosensitive drum 4 and the intermediate transfer belt 9 are in contact and a charging unit 8 at which the photosensitive drum 4 and the charging roller 5 are in contact in the rotating direction of the photosensitive drum 4. The blade here is a contact member disposed in contact with the photosensitive drum 4 to clean the toner remaining on the photosensitive drum 4. The toner remaining on the photosensitive drum 4 after passing through the primary transfer portion is again charged to negative polarity while passing through the charging unit 8 at which the charging roller 5 and the photosensitive drum 4 are in contact and is thereafter collected by the developing unit 7 at the position where the developing unit 7 and the photosensitive drum 4 are in contact.

In the image forming units 3 of the individual colors, toner images are primarily transferred in sequence from the photosensitive drums 4 to the intermediate transfer belt 9, so that a four-color toner image corresponding to the target color image is formed on the intermediate transfer belt 9. Then, the four-color toner image primarily transferred to the intermediate transfer belt 9 is secondarily transferred collectively to the surface of a transfer material P, such as paper or an OHP sheet, while passing through a secondary transfer portion 19 formed between a secondary transfer roller 14 and the intermediate transfer belt 9 into contact with each other. The transfer material P is supplied from a sheet feeding cassette 11 by a sheet feeding unit 12 and is conveyed to the secondary transfer portion 19.

The secondary transfer roller 14, which is a secondary transfer member in contact with the outer circumferential surface of the intermediate transfer belt 9, is driven to rotate together with the intermediate transfer belt 9. The facing roller 23*d* is disposed at a position facing the secondary transfer roller 14, with the intermediate transfer belt 9 therebetween. A current flows from the secondary transfer roller 14 to the facing roller 23*d* by applying positive voltage from a secondary transfer power source 21 to the secondary transfer roller 14, so that the four-color toner image is secondarily transferred from the intermediate transfer belt 9 to the transfer material P at the secondary transfer portion 19.

The transfer material P to which the four color toner image is transferred by a secondary transfer is heated and pressed by the fixing unit 30, so that the four color toners are fused and fixed onto the transfer material P. The transfer material P to which the four color toner image is fixed is discharged from the interior of the image forming apparatus 1 to an output tray 15 by a discharge roller pair 31.

The toner remaining on the intermediate transfer belt 9 after the secondary transfer is collected by a cleaning unit 16 opposed to the facing roller 23*d*, with the intermediate transfer belt 9 therebetween, downstream from the secondary transfer portion 19 in the moving direction of the intermediate transfer belt 9. The cleaning unit 16 includes a cleaning blade 16*a* that is in contact with the outer circumferential surface of the intermediate transfer belt 9 and a residual toner container (not shown). The cleaning blade 16*a* is a collecting member capable of collecting toner remaining on the intermediate transfer belt 9 into the residual toner container by pressing a fixed surface against the rotating intermediate transfer belt 9. In the present embodiment, the cleaning blade 16*a* is made of urethane rubber whose hardness measured by an ASKER micro-rubber hardness tester MD-1capa is 70°. The cleaning blade 16*a* is disposed at a pressure of 1,200 gf against the intermediate transfer belt 9.

The image forming apparatus 1 of the present embodiment forms a full-color print image by the above operation.

The image forming apparatus 1 of the present embodiment has a configuration in which a speed difference ΔV is provided between the surface speed Va (a first speed) of the photosensitive drum 4 and the surface speed Vb (a second speed) of the intermediate transfer belt 9. In the present embodiment, the surface speed of the driving roller 23*a* obtained from the rotational speed of the driving roller 23*a* that transmits driving to the intermediate transfer belt 9 and the outside diameter of the driving roller 23*a* is defined as the surface speed Vb of the intermediate transfer belt 9. Specifically, the surface speed Vb of the intermediate transfer belt 9 was set to 100 mm/sec, and the surface speed Va of the photosensitive drum 4 was set to 103 mm/sec. At that time, the speed difference ΔV between the photosensitive drum 4 and the intermediate transfer belt 9 was obtained using the following expression with reference to the surface speed Vb of the intermediate transfer belt 9.

$$\Delta V = \frac{|Va - Vb|}{Vb} \times 100 \tag{1}$$

In other words, in the present embodiment, the surface speed Vb of the intermediate transfer belt 9 is lower than the surface speed Va of the photosensitive drum 4, and the speed difference ΔV between the surface speed Vb of the intermediate transfer belt 9 and the surface speed Va of the photosensitive drum 4 is 3%. In the present embodiment, the driving source for the rotation of the intermediate transfer belt 9 and the photosensitive drum 4 is one motor, and the driving is branched and obtained from the common driving source. The speed difference ΔV is set by adjusting the gear speed transmission ratio of a gear train that transmits driving from the common driving source to the intermediate transfer belt 9 and the photosensitive drum 4. For the setting of the speed difference ΔV, at least one of the speed transmission ratio of a gear that transmits driving to the photosensitive drum 4 and the speed transmission ratio of a gear that transmits driving to the intermediate transfer belt 9 may be adjusted.

When the surface speed Va of the photosensitive drum 4 and the surface speed Vb of the intermediate transfer belt 9 differ, of the photosensitive drum 4 and the intermediate transfer belt 9, one with a lower surface speed is given the driving force from one with a higher surface speed. Such a driving force is likely to occur remarkably when the amount of toner at the primary transfer portion 2 is small. This is because, when the amount of toner at the primary transfer portion 2 is small, the area of contact between the surface of the photosensitive drum 4 and the surface of the intermediate transfer belt 9 is wide, so that the frictional force tends to be high. In contrast, when the amount of toner at the primary transfer portion 2 increases, the toner present between the photosensitive drum 4 and the intermediate transfer belt 9 acts as a lubricant, decreasing the frictional force generated between the photosensitive drum 4 and the intermediate transfer belt 9.

In the configuration in which the surface speed Va of the photosensitive drum 4 and the surface speed Vb of the intermediate transfer belt 9 differ, a member with a lower surface speed can be taken along a member with a higher surface speed by the driving force described above. This can cause blurring or color misalignment in an image transferred from the photosensitive drum 4 to the intermediate transfer belt 9, posing the risk of image defect. Whether the member is taken along can be determined by measuring the rotational driving loads of the members.

The operational advantages of the present embodiment will be described herein below with reference to FIGS. 2A to 5.

Figure 2A:
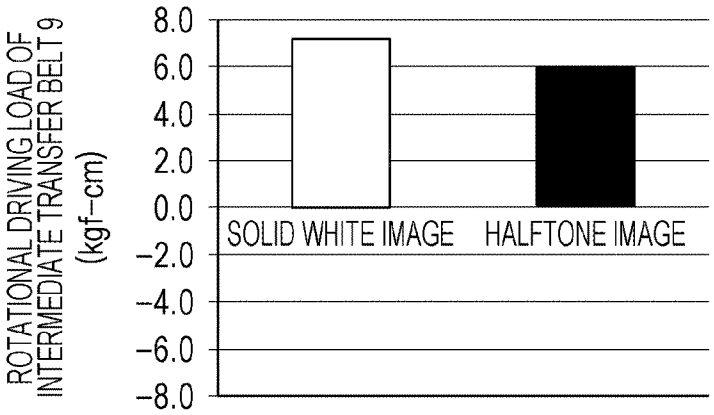
FIG. 2A is a graph illustrating the measurement result of the rotational driving load of an intermediate transfer belt in a comparative example.
Figure 2B:
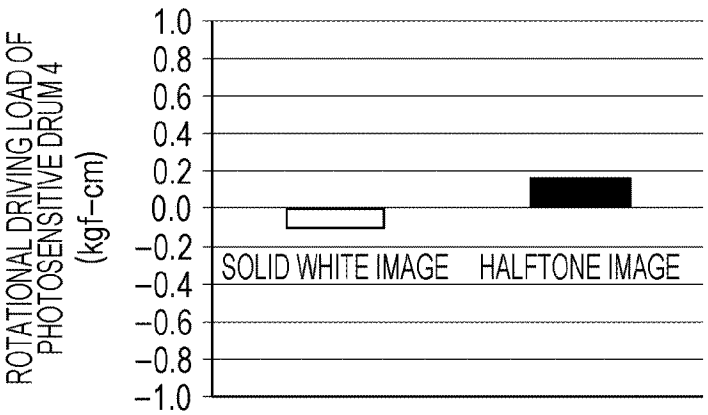
FIG. 2B is a graph illustrating the measurement result of the rotational driving load of a photosensitive drum in the comparative example.
Figure 2C:
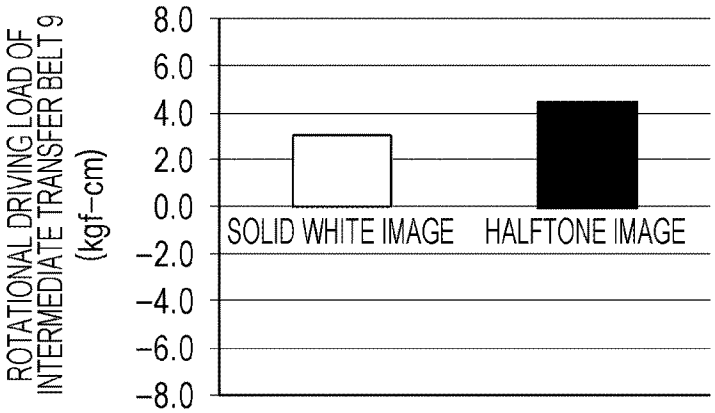
FIG. 2C is a graph illustrating the measurement result of the rotational driving load of the intermediate transfer belt in the first embodiment.
Figure 2D:
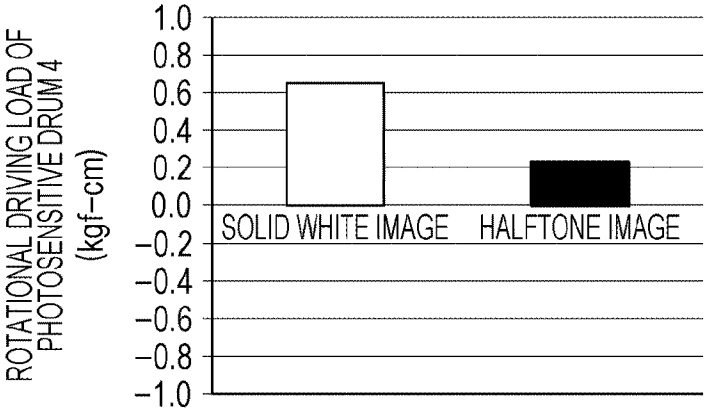
FIG. 2D is a graph illustrating the measurement result of the rotational driving load of the photosensitive drum in the first embodiment.

FIG. 2A is a graph illustrating the measurement result of the rotational driving load of the intermediate transfer belt 9 in a comparative example. FIG. 2B is a graph illustrating the measurement result of the rotational driving load of the photosensitive drum 4 in a comparative example. FIG. 2C is a graph illustrating the measurement result of the rotational driving load of the intermediate transfer belt 9 in the present embodiment. FIG. 2D is a graph illustrating the measurement result of the rotational driving load of the photosensitive drum 4 in the present embodiment.

In the configuration of the present embodiment, the surface speed Vb of the intermediate transfer belt 9 was set lower than the surface speed Va of the photosensitive drum 4, while in the configuration of the comparative example, the surface speed Vb of the intermediate transfer belt 9 was set higher than the surface speed Va of the photosensitive drum 4. Specifically, the surface speed Vb of the intermediate transfer belt 9 was set to 100 mm/sec, while the surface speed Va of the photosensitive drum 4 was set to 97 mm/sec. At that time, the speed difference ΔV between the photosensitive drum 4 and the intermediate transfer belt 9 in the comparative example was 3%.

First, a method for measuring the respective rotational driving loads of the photosensitive drum 4 and the intermediate transfer belt 9 will be described. The rotational driving load of the photosensitive drum 4 was measured by directly connecting an external motor for measurement to the rotation shaft of the photosensitive drum 4 via a torque transducer in a state in which the photosensitive drum 4 is disposed in the image forming apparatus. The external motor for measurement was of Model No. PK566AE manufactured by Oriental Motor, and the torque transducer was of Model No. TM36-10 manufactured by SSK Co. Ltd. The rotational driving load of the intermediate transfer belt 9 was measured by directly connecting an external motor for measurement to the rotation shaft of the driving roller 23*a* for the intermediate transfer belt 9 via a torque transducer.

The measurement of the rotational driving loads of the photosensitive drum 4 and the intermediate transfer belt 9 was performed on two kinds of image of a solid white image (blank image) and a halftone image. The halftone image is an image in which a black color of 80 mm with a concentration of 20%, a cyan color of 80 mm with a concentration of 20%, and a magenta color of 80 mm with a concentration of 20% are formed continuously. The rotational driving loads in forming a halftone image were measured at the timing when toner images of the individual colors are present at their respective primary transfer portions 2 at the same time. The solid white image is an image obtained when no toner image is transferred to the transfer material. In forming the solid white image, no toner image is transferred from the photosensitive drum 4 to the intermediate transfer belt 9.

As illustrated in FIG. 2A, in the configuration of the comparative example, the rotational driving load of the intermediate transfer belt 9 was smaller in forming a halftone image than in forming a solid white image, and the value of the load was positive for both images. This indicates that the gear for transmitting driving to the intermediate transfer belt 9 is under load, so that adjacent gears of the gear train are engaged with each other.

In contrast, as illustrated in FIG. 2B, the value of the rotational driving load of the photosensitive drum 4 in the configuration of the comparative example was negative in the case of forming a solid white image. This indicates that the photosensitive drum 4 is taken along the intermediate transfer belt 9 with a higher surface speed. In such a state, the toner image transferred from the photosensitive drum 4 to the intermediate transfer belt 9 at the primary transfer portion 2 is likely to have an image defect.

In forming a halftone image, the value of the rotational driving load of the photosensitive drum 4 was positive, and the photosensitive drum 4 was not taken along the intermediate transfer belt 9. This is because the toner present at the primary transfer portion 2 when forming the halftone image is larger than the toner present at the primary transfer portion 2 when forming the solid white image, and the toner acts as a lubricant. Thus, in the configuration of the comparative example, the photosensitive drum 4 is taken along the intermediate transfer belt 9 according to the amount of toner of the image to be formed, so that the surface speed Va of the photosensitive drum 4 fluctuates.

In the configuration of the present embodiment, as illustrated in FIG. 2D, the measurement result of the rotational driving load of the photosensitive drum 4 was positive regardless of the image to be formed, as compared with the measurement result of the rotational driving load of the photosensitive drum 4 in the configuration of the comparative example. In the configuration of the present embodiment in which the surface speed Va of the photosensitive drum 4 is higher than the surface speed Vb of the intermediate transfer belt 9, the photosensitive drum 4 is subjected to a force in the direction of a rotational driving load by the intermediate transfer belt 9 with lower surface speed. As a result, a load is applied to the gear for transmitting driving to the photosensitive drum 4, which prevents the engagement of adjacent gears in the gear train from being loosened.

Meanwhile, the intermediate transfer belt 9 whose surface speed is lower than the surface speed of the photosensitive drum 4 is subjected to a force in a direction in which it is taken along the photosensitive drum 4. However, as illustrated in FIG. 1, the intermediate transfer belt 9 is pressed by the cleaning blade 16*a* for collecting the toner remaining on the intermediate transfer belt 9 after the secondary transfer. This causes a sufficient rotational driving load to be applied to the intermediate transfer belt 9. Therefore, as illustrated in FIG. 2C, the rotational driving load of the intermediate transfer belt 9 is positive regardless of an image to be formed, so that the intermediate transfer belt 9 is not taken along the photosensitive drum 4.

Next, whether an image defect and color misalignment have occurred was determined, and the transfer efficiency was evaluated, with the surface speed Va of the photosensitive drum 4 changed with respect to the surface speed Vb (100 mm/sec) of the intermediate transfer belt 9. Specifically, three kinds of image were formed for seven cases in which the surface speed Va of the photosensitive drum 4 is 97, 99, 100, 101, 103, 105, and 106 mm/sec, and were individually evaluated. At that time, an environment for forming the images was as follows: the temperature was 23° C., the humidity was 50%, the processing speed was 100 mm/sec (throughput: 18 per minute), and the image forming mode was a plane paper mode. The transfer material P was an A4-size Red Label Presentation having a basis weight of 80 g/m$^2$.

Figure 3A:
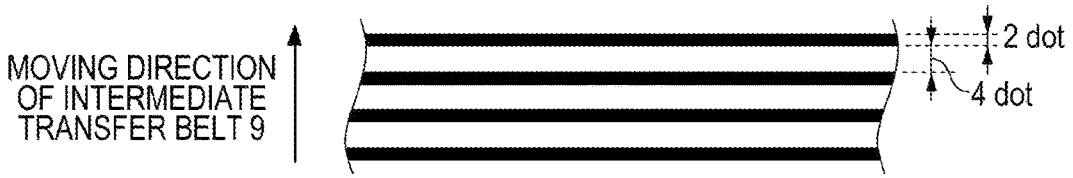
FIG. 3A is a schematic diagram illustrating an image formed to perform an evaluation of whether an image defect has occurred in the first embodiment.

FIG. 3A is a schematic diagram illustrating an image formed to perform an evaluation of whether an image defect has occurred. The evaluation on whether an image defect has occurred was performed by forming a 2-dot black longitudinal horizontal line every four dots with a resolution of 600 dpi in the moving direction of the intermediate transfer belt 9 and determining whether an image blur has occurred, as illustrated in FIG. 3A.

Figure 3B:
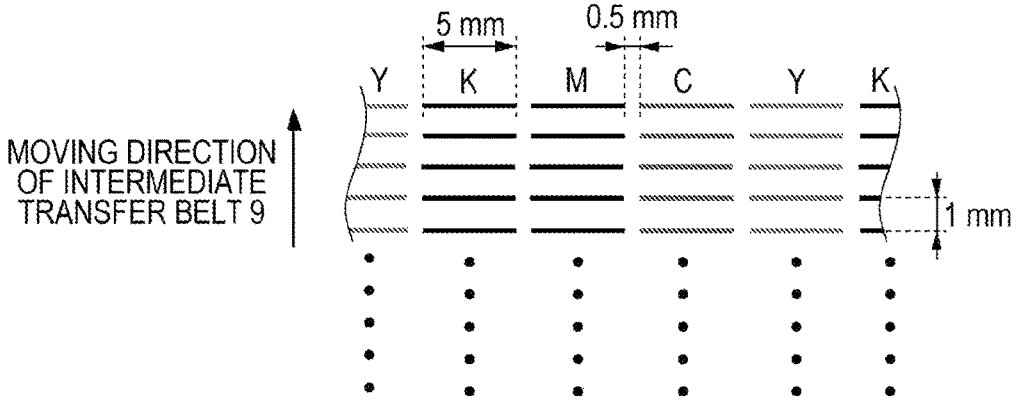
FIG. 3B is a schematic diagram illustrating an image formed to perform an evaluation of color misalignment in the first embodiment.

FIG. 3B is a schematic diagram illustrating an image formed to perform an evaluation of color misalignment. For the image for the evaluation of color misalignment, an image in which a horizontal thin line with a length of 5 mm is repeatedly arranged at an interval of 0.5 mm in the order of magenta (M), cyan (C), yellow (Y), and black (K) was formed as illustrated in FIG. 3B. The interval between the horizontal thin lines of each color in the moving direction of the intermediate transfer belt 9 was 1 mm. For the evaluation of color misalignment, black was used as a reference color, and the amount of misalignment of the horizontal thin lines of each color with respect to the black horizontal thin lines in the moving direction of the intermediate transfer belt 9 was obtained as the amount of color misalignment, and the maximum value of the obtained color misalignment amounts was used for evaluation.

The transfer efficiency was evaluated by measuring the concentration of toner remaining on the photosensitive drum 4 without being transferred to the intermediate transfer belt 9 when a black solid image was formed. The transfer residual concentration was measured using a reflectometer (type: TC-6DS/A) manufactured by Nippon Denshoku Industries.

Figure 5:
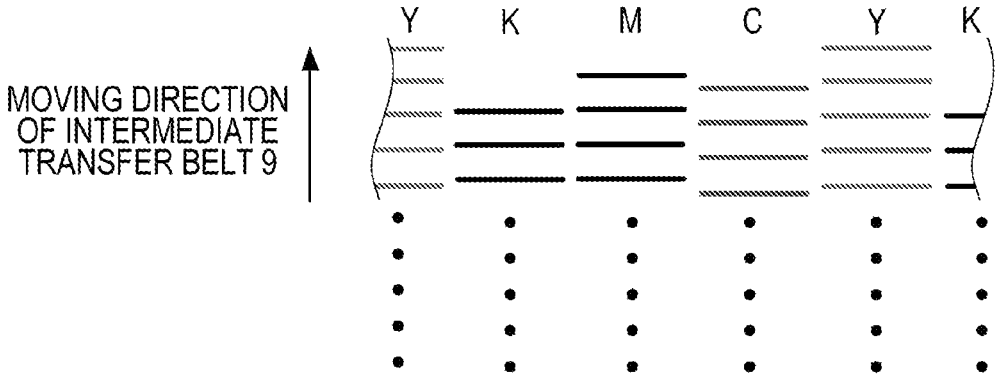
FIG. 5 is a schematic diagram illustrating an image obtained when color misalignment has occurred.
Figure 6:
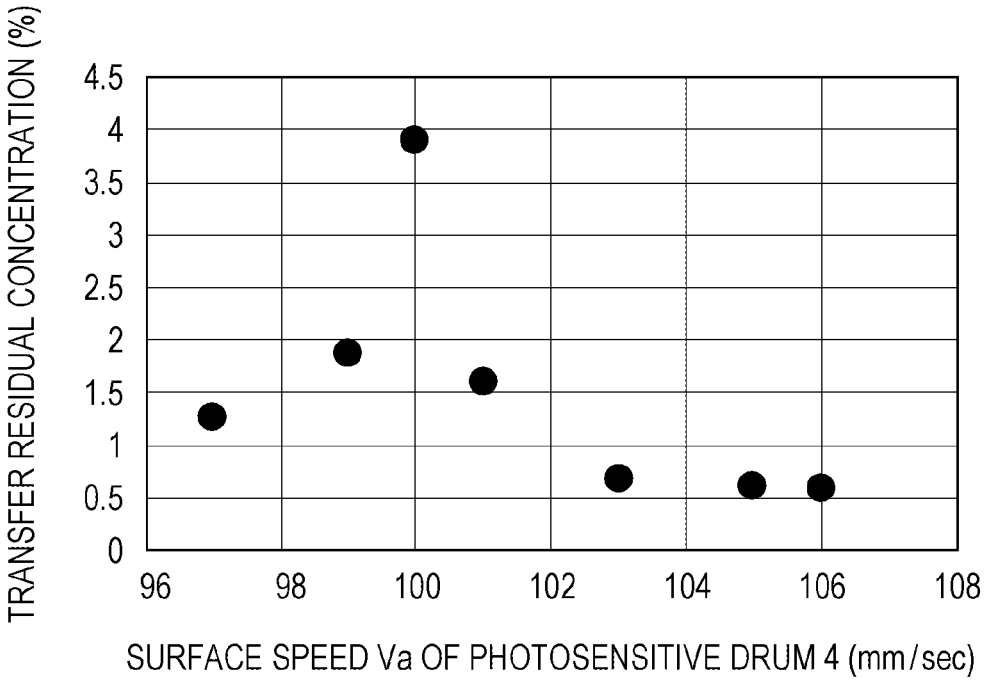
FIG. 6 is a graph illustrating the result of evaluation of transfer efficiency at various speed differences in the first embodiment.

FIG. 4 is a table illustrating the result of evaluation of whether an image defect and color misalignment have occurred at various speed differences ΔV. In FIG. 4, generation of an image blur or color misalignment at the level recognized as an image defect is represented as "poor". FIG. 5 is a schematic diagram illustrating an image in which color misalignment has occurred. FIG. 6 is a graph illustrating the measurement result of transfer residual concentration at various speed difference ΔV in the case where the surface speed Va of the photosensitive drum 4 with respect to the surface speed Vb of the intermediate transfer belt 9 is varied.

As illustrated in FIG. 4, for an image blur, when the surface speed Vb (100 mm/sec) of the intermediate transfer belt 9 is higher than the surface speed Va of the photosensitive drum 4, a transverse band-like image defect has occurred at the positions of about 22 mm and about 36 mm from the leading end of the image. The transverse band at the position of about 22 mm from the leading end matches the length of the arc of the photosensitive drum 4 from the primary transfer portion 2 to the developing unit 7, and the transverse band at the position of about 36 mm from the leading end matches the length of the arc of the photosensitive drum 4 from the primary transfer portion 2 to the exposing unit 6.

This image defect occurs because a frictional force between the photosensitive drum 4 and the intermediate transfer belt 9 decreases when the leading end of the toner image carried on the photosensitive drum 4 enters the primary transfer portion 2, and the rotational driving load of the photosensitive drum 4 abruptly changes. When the rotational driving load of the photosensitive drum 4 at a portion carrying no toner image is negative, as illustrated in FIG. 2B, the rotational driving load of the photosensitive drum 4 can be inverted to a positive value when the leading end of the toner image enters the primary transfer portion 2, and the toner acts as a lubricant. At that time, the surface speed Va of the photosensitive drum 4 changes abruptly, causing an image blur and an image defect.

The color misalignment will be described with reference to Table 1 and FIG. 5. As illustrated in Table 1, when the surface speed Vb (100 mm/sec) of the intermediate transfer belt 9 is higher than the surface speed Va of the photosensitive drum 4, significant color misalignment has occurred.

TABLE 1

| | | SURFACE SPEED Va (mm/sec) | | | | | | |
|---|---|---|---|---|---|---|---|---|
| | | 97 | 99 | 100 | 101 | 103 | 105 | 106 |
| AMOUNT OF COLOR MISALIGNMENT (μm) | FIRST | 1,812 | 1,518 | 100 | 98 | 98 | 91 | 107 |
| | SECOND | 1,756 | 1,485 | 96 | 102 | 90 | 93 | 103 |
| | THIRD | 1,989 | 1,477 | 96 | 103 | 106 | 110 | 101 |
| | AVERAGE | 1,852 | 1,493 | 97 | 101 | 98 | 98 | 104 |

In the case where the photosensitive drum 4 is taken along the intermediate transfer belt 9 with higher surface speed, when the leading end of the toner image carried on the photosensitive drum 4 reaches the primary transfer portion 2, the toner acts as a lubricant, so that the state in which the photosensitive drum 4 is taken along the intermediate transfer belt 9 is resolved. At that time, the gears for transmitting driving to the photosensitive drum 4 come from the loose state to an engaged state, so that the photosensitive drum 4 is switched from the state of being taken along the intermediate transfer belt 9 to a rotating state by receiving the driving force from the driving source. During the switching, no rotational force is given to the photosensitive drum 4 from both of the intermediate transfer belt 9 and the driving source, so that the rotation of the photosensitive drum 4 temporarily stops. This causes misalignment of the leading ends of the toner images transferred from the photosensitive drums 4 to the intermediate transfer belt 9. In particular, the larger the force of taking the photosensitive drum 4 along the intermediate transfer belt 9, the longer the time during which the photosensitive drum 4 stops, increasing the misalignment of the leading ends of the toner images.

In forming the image as illustrated in FIG. 3B, in a state in which no toner image is transferred to the intermediate transfer belt 9, the intermediate transfer belt 9 applies a rotational force to the four photosensitive drums 4, so that the photosensitive drums 4 are taken along the intermediate transfer belt 9. When image formation is started from this state, the state of being taken along the intermediate transfer belt 9 in the moving direction of the intermediate transfer belt 9 is resolved in sequence from the upstream photosensitive drum 4. In other words, the upstream photosensitive drum 4Y in the moving direction of the intermediate transfer belt 9 receives the smallest force of taking the photosensitive drum 4Y along the intermediate transfer belt 9, and the downstream photosensitive drum 4K receives the largest force of taking the photosensitive drum 4K along the intermediate transfer belt 9. This is because the photosensitive drum 4K located at the most downstream side is taken along by the rotational force from the intermediate transfer belt 9, with the state in which the photosensitive drums 4Y, 4M, and 4C are taken along the intermediate transfer belt 9 resolved.

Therefore, as illustrated in FIG. 5, the leading end of the toner image formed on the downstream photosensitive drum 4 and the leading end of the toner image formed on the upstream photosensitive drum 4 are transferred in a misaligned manner in the moving direction of the intermediate transfer belt 9. The misalignment of the leading ends of the toner images of the individual colors causes significant color misalignment in the image formed on the transfer material P.

In contrast, in the case where the surface speed Vb (100 mm/sec) of the intermediate transfer belt 9 is lower than the surface speed Va of the photosensitive drum 4, a sufficient load is applied to the intermediate transfer belt 9 by the cleaning blade 16*a*, as illustrated in FIGS. 2C and 2D. Therefore, the intermediate transfer belt 9 with a low surface speed is not taken along the photosensitive drum 4 with a high surface speed, so that the gears for transmitting driving to the photosensitive drum 4 and the driving roller 23*a* for the intermediate transfer belt 9 are not loosened. This prevents significant color misalignment of an image formed on the transfer material P.

In a configuration in which the surface speed Vb of the intermediate transfer belt 9 and the surface speed Va of the photosensitive drum 4 are equal, that is, the speed difference ΔV is 0%, the photosensitive drum 4 is not taken along the intermediate transfer belt 9, so that color misalignment is prevented.

For the transfer efficient, as illustrated in FIG. 6, the transfer residual concentration of the toner when the surface speed Va of the photosensitive drum 4 and the surface speed Vb of the intermediate transfer belt 9 are set to the same value was highest. The configuration in which there is a speed difference ΔV between the surface speed Va of the photosensitive drum 4 and the surface speed Vb of the intermediate transfer belt 9 allows lower transfer residual concentration and therefore higher transfer efficiency than those of the configuration having no speed difference ΔV.

If the value of the speed difference ΔV is too great, the toner image is rubbed at the primary transfer portion 2 at which the photosensitive drum 4 and the intermediate transfer belt 9 are in contact, so that an image defect can occur, that is, the toner image may lose its shape. In the present embodiment, the image defect due to the loss of the shape of the toner image occurred when the surface speed Va of the photosensitive drum 4 was set to 106 mm/sec with respect to the surface speed Vb (100 mm/sec) of the intermediate transfer belt 9. For that reason, it is more preferable to set the speed difference ΔV within 5% in the viewpoint of preventing the image defect, described above.

As described above, the configuration of the present embodiment allows the cleanerless image forming apparatus 1 including no cleaning blade, which is a cleaning member in contact with the photosensitive drum 4, to have the following advantages. By providing a speed difference ΔV between the photosensitive drum 4 and the intermediate transfer belt 9 to improve the transfer efficiency and setting the surface speed Vb of the intermediate transfer belt 9 lower than the surface speed Va of the photosensitive drum 4, an image defect caused by the photosensitive drum 4 being taken along the intermediate transfer belt 9 can be prevented.

In the present embodiment, a cleanerless configuration in which there is no toner collecting member is provided between the primary transfer portion 2 and the charging unit 8 in the rotating direction of the photosensitive drum 4 has been described for the image forming apparatus 1 in which the load of rotationally driving the photosensitive drum 4 is small. However, the present disclosure may not have this configuration. For example, a brush or another member for temporarily collecting the toner remaining on the photosensitive drum 4 may be provided in the cleanerless configuration in which the toner remaining on the photosensitive drum 4 after passing through the primary transfer portion 2 is collected by the developing unit 7. Another alternative example is a configuration including a charging roller that charges the toner remaining on the photosensitive drum 4. The configuration including a brush or a charging roller that rotates in contact with the photosensitive drum 4 has a lower load for rotationally driving the photosensitive drum 4 than that of the configuration in which the cleaning blade or another member is pressed against the photosensitive drum 4. Consequently, when the surface speed Vb of the intermediate transfer belt 9 is set higher than the surface speed Va of the photosensitive drum 4, the photosensitive drum 4 may be taken along the intermediate transfer belt 9. For that reason, using the configuration of the present embodiment prevents image defects while improving the transfer efficiency.

In the present embodiment, the speed difference ΔV is provided between the photosensitive drum 4 and the intermediate transfer belt 9 by adjusting the speed transmission ratio of the gears of the gear train using a single motor, which is a common driving source. However, this is given for illustration purposes only. The speed difference ΔV may be set not by adjusting the gear speed transmission ratio but by adjusting the diameter of the driving shaft of the photosensitive drum 4 or the diameter of the driving roller 23*a* for the intermediate transfer belt 9. Alternatively, the speed difference ΔV may be set by providing separate driving sources for the photosensitive drum 4 and the intermediate transfer belt 9.

Second Embodiment

In the first embodiment, the configuration of the image forming apparatus 1 including the intermediate transfer belt 209 including the endless polyimide (PI) base layer in which carbon is added as a conductive agent and the surface layer containing acrylic resin formed on the outer circumferential surface of the base layer has been described. In contrast, an image forming apparatus 200 of a second embodiment includes an intermediate transfer belt 209 including a base layer 209*a*, a surface layer 209*b* formed on the outer circumferential surface of the base layer 209*a*, and an inner surface layer 209*c* formed on the inner circumferential surface of the base layer 209*a*. The configuration of the image forming apparatus 200 of the present embodiment is similar to that of the first embodiment except the configuration of the intermediate transfer belt 209 and that the respective primary transfer rollers 10 of the four image forming units 3 are given a voltage from a common primary transfer power source 20. The same components as those of the first embodiment are therefore denoted by the same reference signs, and descriptions thereof will be omitted.

Figure 7:
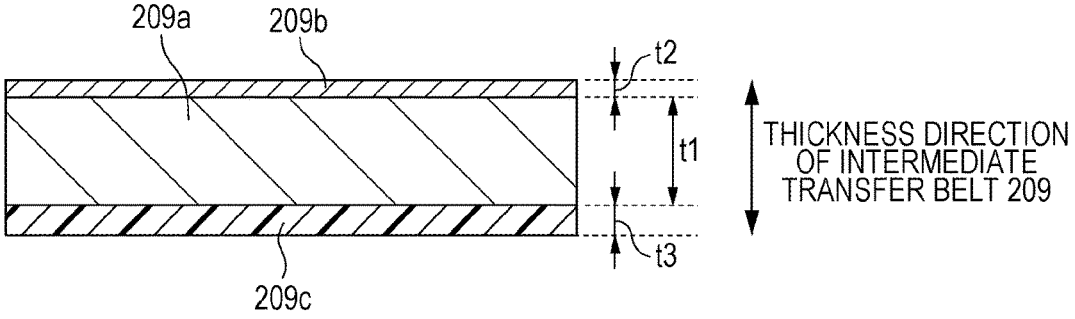
FIG. 7 is a cross-sectional view of an intermediate transfer belt of a second embodiment illustrating, in outline, the configuration thereof.
Figure 8:
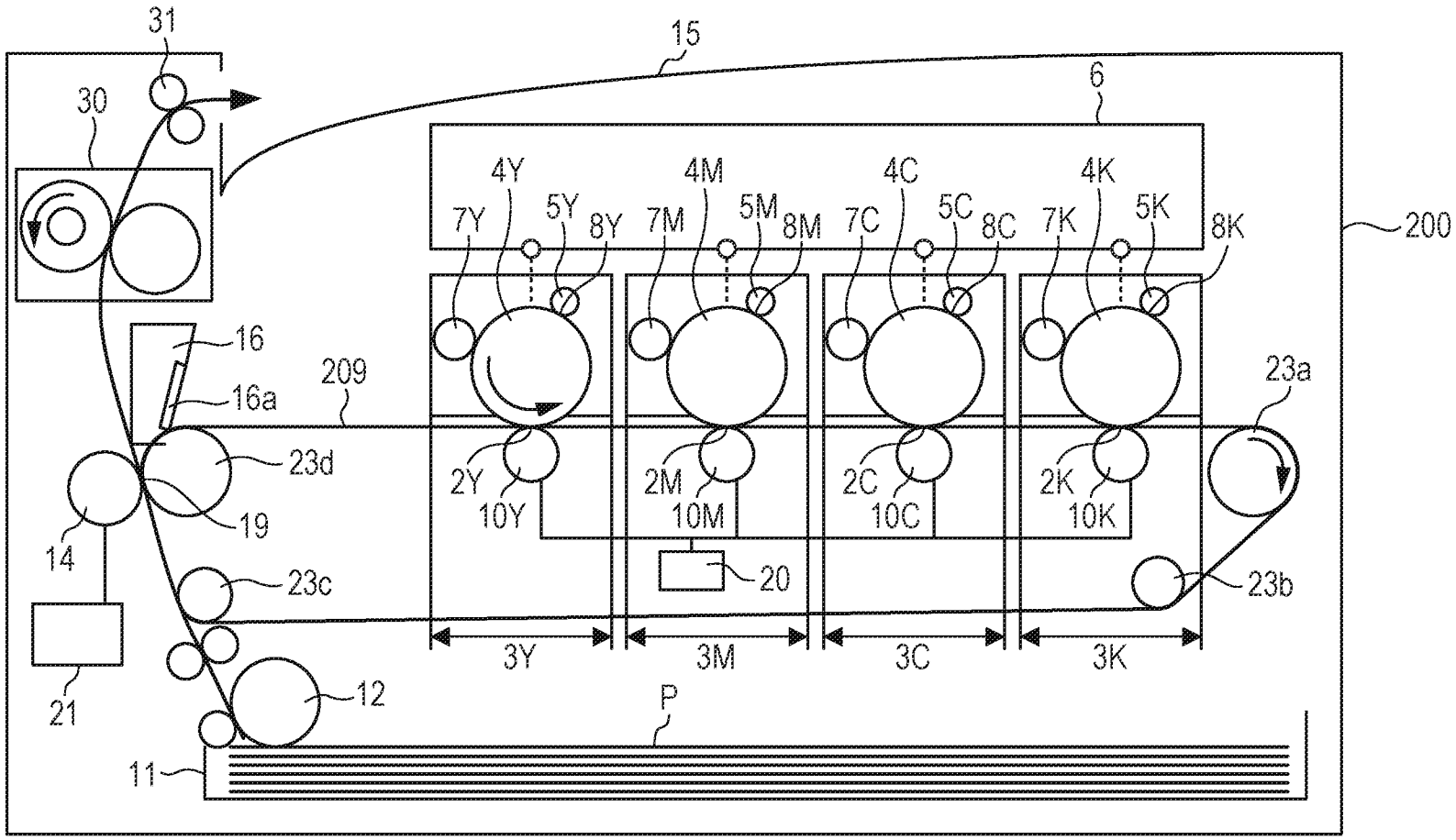
FIG. 8 is a sectional view of an image forming apparatus of the second embodiment illustrating, in outline, the configuration thereof.

FIG. 7 is a schematic diagram illustrating a cross section of the intermediate transfer belt 209 of the present embodiment. FIG. 8 is a sectional view of the image forming apparatus 200 of the present embodiment illustrating, in outline, the configuration thereof.

As illustrated in FIG. 7, the intermediate transfer belt 209 is an intermediate transfer member including a plurality of layers: the base layer 209*a* (a first layer), the surface layer 209*b* (a third layer) formed on the outer circumferential surface of the base layer 209*a*, and the inner surface layer 209*c* (a second layer) formed on the inner circumferential surface of the base layer 209*a*. The base layer 209*a* and the surface layer 209*b* respectively have the same configurations as those of the base layer and the surface layer of the first embodiment. The inner surface layer 209*c* is an acrylic resin layer in which carbon is mixed as a conductive agent and is formed at a position farther from the photosensitive drum 4 than the base layer 209*a* in the thickness direction of the intermediate transfer belt 209. A thickness t3 of the inner surface layer 209*c* of the present embodiment is 3 μm The surface resistivity of the intermediate transfer belt 209 measured from the inner surface layer 209*c* side was $4.7\times10^{6}\Omega/\square$, and the surface resistivity measured from the surface layer 209*b* side was $2.6\times10^{11}\Omega/\square$. The surface resistivity was measured with the same measuring instrument as that for the volume resistivity and a ring probe of type UR100 (type MCP-HTP16) under the measurement conditions of an applied voltage of 10 V and a measuring time of 10 seconds. The environment for measurement was a room temperature of 23° C. and a room humidity of 50%.

In the configuration of the present embodiment, the surface resistivity on the inner circumferential surface of the intermediate transfer belt 209 is sufficiently lower than the surface resistivity on the outer circumferential surface of the intermediate transfer belt 209 because of the presence of the inner surface layer 209*c*. For that reason, when a voltage is applied from the primary transfer power source 20 to the primary transfer rollers 10, a current flows via the inner surface layer 209*c* with lower electrical resistance, so that a uniform potential is formed across the intermediate transfer belt 209. As a result, electrical discharge (hereinafter referred to as upstream discharge) is likely to occur upstream from each primary transfer portion 2 in the moving direction of the intermediate transfer belt 209 due to the potential difference between the photosensitive drum 4 and the intermediate transfer belt 209. This upstream discharge causes a decrease in the potential of the photosensitive drum 4 at the primary transfer portion 2 at which the photosensitive drum 4 and the intermediate transfer belt 209 are in contact, decreasing the electrostatic attracting force acting between the photosensitive drum 4 and the intermediate transfer belt 209 at the primary transfer portion 2. As a result, the frictional force between the photosensitive drum 4 and the intermediate transfer belt 209 decreases.

Figure 9A:
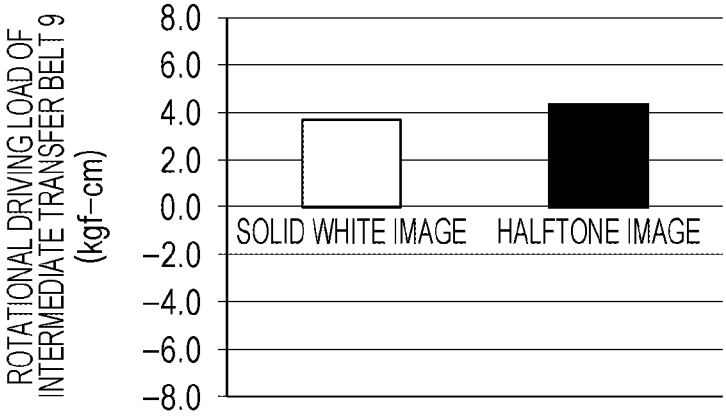
FIG. 9A is a graph illustrating the measurement result of the rotational driving load of the intermediate transfer belt in the second embodiment.
Figure 9B:
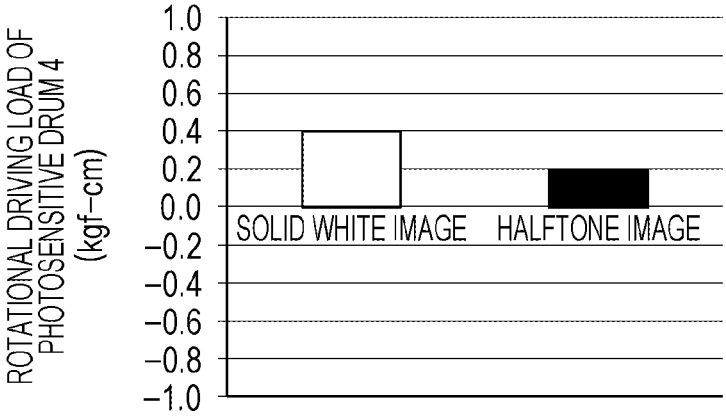
FIG. 9B is a graph illustrating the measurement result of the rotational driving load of a photosensitive drum in the second embodiment.

FIG. 9A is a graph illustrating the measurement result of the rotational driving load of the intermediate transfer belt 209 in the present embodiment, and FIG. 9B is a graph illustrating the measurement result of the rotational driving load of the photosensitive drum 4 in the present embodiment. A method for measuring the rotational driving loads of the photosensitive drum 4 and the intermediate transfer belt 209 is the same as the measuring method of the first embodiment.

As illustrated in FIG. 9A, the value of the rotational driving load of the intermediate transfer belt 209 when a solid white image is formed in the present embodiment was greater than the value of the rotational driving load of the intermediate transfer belt 209 when a solid white image is formed in the first embodiment, illustrated in FIG. 2C. This is because, the frictional force between the photosensitive drum 4 and the intermediate transfer belt 209 was reduced by providing the inner surface layer 209*c*, so that the force of the photosensitive drum 4 with higher surface speed to take along the intermediate transfer belt 209 with lower surface speed was decreased. In contrast, the value of the rotational driving load of the intermediate transfer belt 209 when a halftone image is formed was substantially unchanged from the first embodiment.

As illustrated in FIG. 9B, the value of the rotational driving load of the photosensitive drum 4 when a solid white image is formed in the present embodiment was lower than the value of the rotational driving load of the photosensitive drum 4 when a solid white image was formed in the first embodiment illustrated in FIG. 2D. This is because the frictional force between the photosensitive drum 4 and the intermediate transfer belt 209 was decreased because of the inner surface layer 209*c*. In contrast, the value of the rotational driving load of the photosensitive drum 4 when a halftone image is formed was substantially unchanged from the first embodiment, like the value of the rotational driving load of the intermediate transfer belt 209.

As described above, the configuration of the present embodiment reduces or eliminates fluctuations in the rotational driving loads of the photosensitive drum 4 and the intermediate transfer belt 209 depending on whether toner is interposed at the primary transfer portion 2. In other words, the present embodiment reduces or eliminates fluctuations in the rotational driving loads of the photosensitive drum 4 and the intermediate transfer belt 209 when the leading end of the toner image carried on the photosensitive drum 4 enters the primary transfer portion 2.

Next, evaluation of color misalignment in the present embodiment will be described using Table 2. A method for evaluating the color misalignment is the same as the method of the first embodiment. The image illustrated in FIG. 3A was formed under the same conditions as those of the first embodiment, and the evaluation was performed.

TABLE 2

| | | FIRST EMBODIMENT | SECOND EMBODIMENT |
|---|---|---|---|
| AMOUNT OF COLOR MISALIGNMENT (μm) | FIRST | 98 | 56 |
| | SECOND | 90 | 53 |
| | THIRD | 106 | 61 |
| | AVERAGE | 98 | 57 |

As illustrated in Table 2, the configuration of the present embodiment allows the value of the amount of color misalignment to be lower than that of the first embodiment. This is because the presence of the inner surface layer 209*c* reduces or eliminates fluctuations in the rotational driving loads of the photosensitive drum 4 and the intermediate transfer belt 209 when the leading end of the toner image carried by the photosensitive drum 4 enters the primary transfer portion 2.

As described above, the configuration of the present embodiment can not only offer the same advantages as those of the first embodiment but also reduce or eliminate the color misalignment of an image formed on the transfer material P regardless of the amount of the toner of the toner image transferred to the intermediate transfer belt 209.

In the present embodiment, the presence of the inner circumferential surface 209*c* allows a uniform potential to be formed across the intermediate transfer belt 209. This allows a stable potential to be formed at each primary transfer portion 2 even in the configuration in which a single primary transfer power source is used in common to apply a voltage to each primary transfer roller 10, and the single primary transfer power source 20 is connected to the individual primary transfer rollers 10, as illustrated in FIG. 8. This configuration reduces the number of primary transfer power sources, thereby simplifying and reducing the size and cost of the power supply board.

In the present embodiment, carbon is added as an electron conductive agent to the base layer 209*a* of the intermediate transfer belt 209. The conductive agent added to the base layer 209*a* is not limited thereto. An ion conductive agent, such as multivalent metal salt or quaternary ammonium salt, may be added. The ion conductive agent is easier to adjust the electrical resistance of the substance to which the conductive agent is added than the electron conductive agent. Therefore, adding the ion conductive agent to the base layer 209*a* can extend the range of adjustment of the electrical resistance of the intermediate transfer belt 209. The intermediate transfer belt 209 to which the ion conductive agent is added has the property that the electrical resistance hardly fluctuates even if the magnitude of the voltage to be applied is changed. For that reason, even when the magnitude of the voltage to be applied to the primary transfer roller 10 is changed, a desired current can be made to flow from the intermediate transfer belt 209 to the photosensitive drum 4.

Another Embodiment

Figure 10:
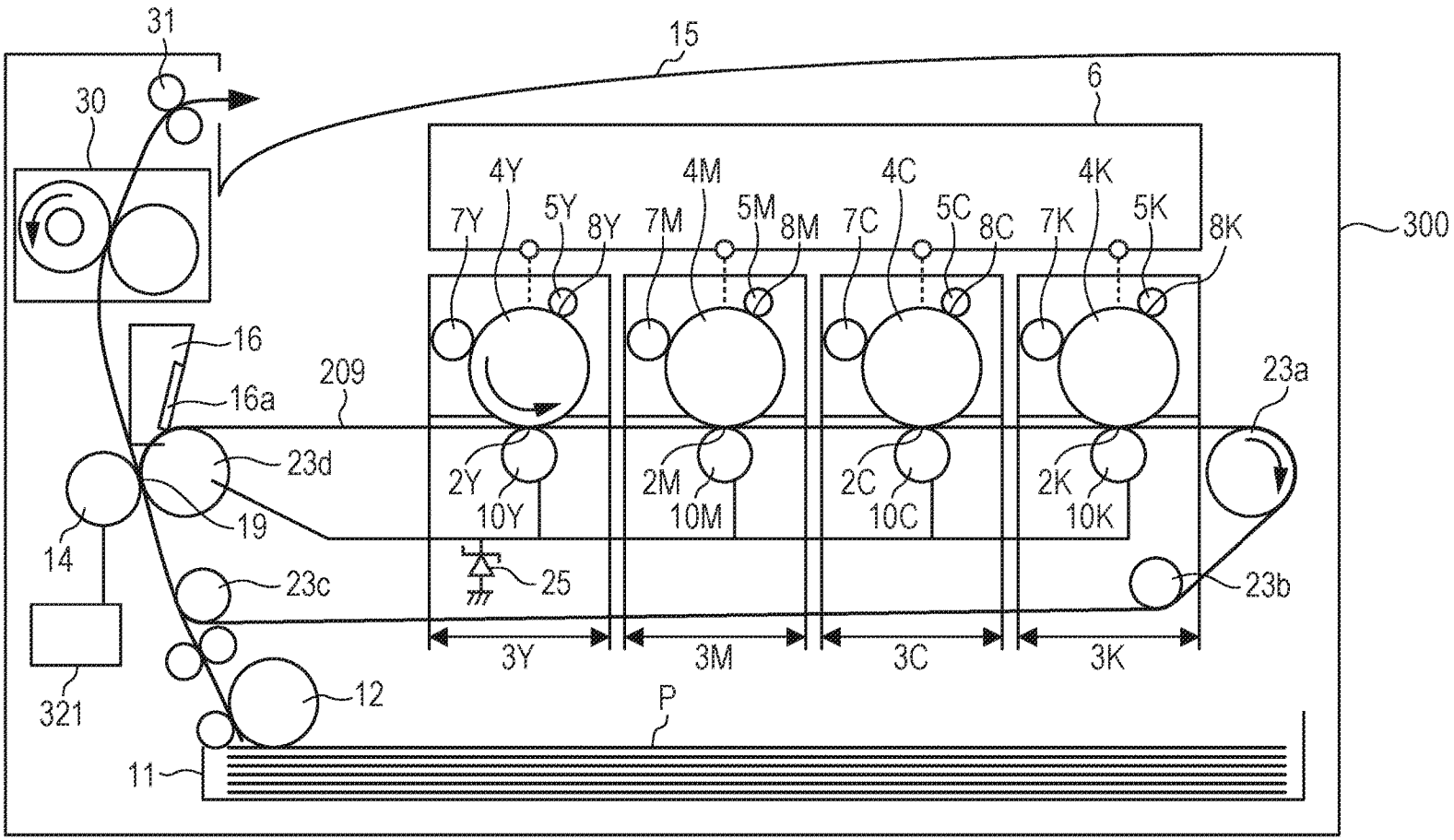
FIG. 10 is a sectional view of an image forming apparatus of another embodiment illustrating, in outline, the configuration thereof.

In the second embodiment, the configuration in which a voltage is applied from the common primary transfer power source 20 to each primary transfer roller 10 at each image forming unit 3 for primary transfer has been described. In contrast, in the present embodiment, as illustrated in FIG. 10, a common primary transfer power source is used for the four image forming units 3, and a common transfer power source is used as the primary transfer power source and the secondary transfer power source. In the configuration of the present embodiment, primary transfer and secondary transfer are performed using the intermediate transfer belt 209 with the same configuration as that of the second embodiment and by applying a voltage from a transfer power source 321 (a second power source) to the secondary transfer roller 14, which is the secondary transfer member. The configuration of an image forming apparatus 300 of the present embodiment is similar to that of the second embodiment except that the primary transfer is performed by applying a voltage from the transfer power source 321 to the secondary transfer roller 14. Components common to the second embodiment are denoted by the same reference signs, and descriptions thereof will be omitted.

FIG. 10 is a sectional view of the image forming apparatus 300 of the present embodiment illustrating, in outline, the configuration thereof. As illustrated in FIG. 10, the transfer power source 321 is connected to the secondary transfer roller 14, and the secondary transfer roller 14 is electrically connected to the ground via the intermediate transfer belt 209, the facing roller 23*d*, which is a facing member, and a Zener diode 25, which is a constant voltage element. The primary transfer rollers 10 are electrically connected to the facing roller 23*d* and are electrically connected to the ground via the Zener diode 25.

The Zener diode 25, which is a constant voltage element, is an element that maintains a predetermined voltage (hereinafter referred to as "breakdown voltage") by the passage of electric current, in which a breakdown voltage is generated on the cathode side when a certain amount of current flows. In the present embodiment, the cathode (one end) of the Zener diode 25 is connected to the facing roller 23*d* and the primary transfer rollers 10, and the anode (the other end) is electrically connected to the ground.

In the configuration of the present embodiment, when a voltage is applied from the transfer power source 321 to the secondary transfer roller 14, a current flows from the secondary transfer roller 14 to the Zener diode 25 via the conductive intermediate transfer belt 209 and the facing roller 23*d*. At that time, when a current of a predetermined value or more flows through the Zener diode 25, a breakdown voltage occurs at the cathode of the Zener diode 25, so that the facing roller 23*d* and each primary transfer roller 10 are maintained at the breakdown voltage of the Zener diode 25. This causes a primary transfer current to flow from the primary transfer roller 10 to the photosensitive drum 4, so that a toner image is primarily transferred from the photosensitive drum 4 to the intermediate transfer belt 209.

Thus, in the present embodiment, since the intermediate transfer belt 209 includes the inner surface layer 209*c*, a desired potential can be formed at each primary transfer portion 2 even with the configuration in which the primary transfer power source and the secondary transfer power source are commonalized, providing a stable primary transfer performance. This configuration reduces the number of primary transfer power sources, thereby simplifying and reducing the size and cost of the power supply board.

The present embodiment has a configuration in which the primary transfer roller 10 in contact with the inner surface layer 209*c* of the intermediate transfer belt 209 and the facing roller 23*d* are electrically connected so that a current flows from the primary transfer roller 10 to the photosensitive drum 4 via the intermediate transfer belt 209. This is given for illustration purpose only. Alternatively, the toner image may be transferred from the photosensitive drum 4 to the intermediate transfer belt 209, without providing the primary transfer roller 10, but by making a current flow in the circumferential direction of the intermediate transfer belt 209 from the facing roller 23*d*. At that time, the current flows from the facing roller 23*d* maintained at the breakdown voltage along the circumference of the intermediate transfer belt 209 via the inner surface layer 209*c* with low surface resistivity in contact with the facing roller 23*d*.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-016205 filed Jan. 31, 2017, which is hereby incorporated by reference herein in its entirety.

What is claimed is:

1. An image forming apparatus comprising:

a photosensitive member configured to carry a toner image, the photosensitive member rotating at a first speed;

an endless rotatable intermediate transfer member in contact with the photosensitive member, the intermediate transfer member rotating at a second speed lower than the first speed, wherein the toner image carried on the photosensitive member is primarily transferred to the intermediate transfer member;

a developing unit configured to develop an electrostatic latent image formed on the photosensitive member to form a toner image, the developing unit collecting toner remaining on the photosensitive member after the toner image is primarily transferred from the photosensitive member to the intermediate transfer member; and a collecting member disposed in a state in which a fixed surface of the collecting member is pressed against the rotating intermediate transfer member, the collecting member collecting toner remaining on the intermediate transfer member after the toner image primarily transferred from the photosensitive member to the intermediate transfer member is secondarily transferred from the intermediate transfer member to a transfer material.

2. The image forming apparatus according to claim 1, further comprising a charging member configured to electrically charge the photosensitive member, wherein a blade in contact with the photosensitive member is not provided between a position at which the photosensitive member and the intermediate transfer member are in contact with each other and a position at which the charging member and the photosensitive member face each other in a rotating direction of the photosensitive member.

3. The image forming apparatus according to claim 1, further comprising:

a secondary transfer member in contact with an outer circumferential surface of the intermediate transfer member; and a facing member facing the secondary transfer member, with the intermediate transfer member therebetween, wherein the collecting member presses the intermediate transfer member downstream from a position at which the intermediate transfer member and the secondary transfer member are in contact with each other in a moving direction of the intermediate transfer member and at which the intermediate transfer member and the facing member are in contact with each other.

4. The image forming apparatus according to claim 1, wherein the collecting member applies a load on rotation of the intermediate transfer member because the fixed surface of the collecting member is pressed against the intermediate transfer member.

5. The image forming apparatus according to claim 1, wherein the intermediate transfer member includes a plurality of layers including a first layer that is a thickest layer of the plurality of layers and a second layer formed at a position farther from the photosensitive member than the first layer in a thickness direction of the intermediate transfer member.

6. The image forming apparatus according to claim 5, wherein a surface resistivity measured on the second layer is lower than a surface resistivity measured on the first layer.

7. The image forming apparatus according to claim 5, wherein the first layer contains an ion conductive agent.

8. The image forming apparatus according to claim 5, further comprising:

a contact member in contact with the second layer of the intermediate transfer member; and a first power source configured to apply a voltage to the contact member, wherein a potential is formed on the intermediate transfer member by applying a voltage from the first power source to the contact member.

9. The image forming apparatus according to claim 5, further comprising:

a secondary transfer member in contact with an outer circumferential surface of the intermediate transfer member;

a second power source configured to apply a voltage to the secondary transfer member; and a facing member in contact with the second layer and facing the secondary transfer member, with the intermediate transfer member therebetween, wherein a potential is formed on the intermediate transfer member by applying a voltage from the second power source to the secondary transfer member to form a potential on the facing member via the intermediate transfer member so that a current flows from the facing member to the second layer.

10. The image forming apparatus according to claim 9, wherein applying a voltage from the second power source to the secondary transfer member allows the toner image to be primarily transferred from the photosensitive member to the intermediate transfer member and the toner image primarily transferred to the intermediate transfer member to be secondarily transferred to a transfer material.

11. The image forming apparatus according to claim 9, further comprising a constant voltage element capable of maintaining a predetermined voltage by passage of a current therethrough via the facing member, wherein one end of the constant voltage element is connected to the facing member, and another end of the constant voltage element is grounded.

12. The image forming apparatus according to claim 9, wherein a difference between the first speed and the second speed is within 5%.

13. The image forming apparatus according to claim 5, wherein, in a state in which a potential is formed on the intermediate transfer member by passage of a current through the second layer, an electrical charge occurs upstream from a position at which the photosensitive member and the intermediate transfer member are in contact in a moving direction of the intermediate transfer member due to a difference between a potential formed on the photosensitive member and the potential formed on the intermediate transfer member.

14. The image forming apparatus according to claim 1, further comprising a common driving source configured to drive the photosensitive member and the intermediate transfer member.

15. The image forming apparatus according to claim 14, wherein the first speed and the second speed are made different by adjusting, in a gear train that transmits driving from the driving source to the photosensitive member and the intermediate transfer member, at least one of a speed transmission ratio of a gear that transmits driving to the photosensitive member and a speed transmission ratio of a gear that transmits driving to the intermediate transfer member.

16. The image forming apparatus according to claim 1, further comprising a rotary member stretching the intermediate transfer member, wherein the second speed is a surface speed of the rotary member.

* * * * *